US005338506A

United States Patent [19]

Friederichs et al.

[11] Patent Number: 5,338,506

[45] Date of Patent: Aug. 16, 1994

[54] PROCESS FOR MAKING NON-MAGNETIC NICKEL TUNGSTEN CARBIDE CEMENTED CARBIDE COMPOSITIONS AND ARTICLES MADE FROM THE SAME

[75] Inventors: John W. Friederichs, West Branch; Prakash K. Mirchandani, Troy; Paul J. Krudy, Wet Branch, all of Mich.

[73] Assignee: Valenite Inc., Madison Hts., Mich.

[21] Appl. No.: 993,790

[22] Filed: Dec. 21, 1992

[51] Int. Cl.[5] ..... B22F 1/00

[52] U.S. Cl. ..... 419/44; 419/36; 419/53; 419/54; 419/56; 419/57; 419/58

[58] Field of Search ..... 75/240, 252, 236, 248; 252/455 R; 419/58, 15, 36, 53, 56, 57, 58, 54, 44; 29/182.7

[56] References Cited

U.S. PATENT DOCUMENTS

| | | | |
|---|---|---|---|
| 3,918,138 | 11/1975 | Nemeth et al. | 29/182.7 |
| 3,932,310 | 1/1976 | Turner | 252/455 R |
| 4,401,482 | 8/1983 | Green et al. | 148/104 |
| 4,456,484 | 3/1984 | Benjamin | 75/252 |
| 4,684,405 | 8/1987 | Kolaska | 75/240 |
| 5,057,147 | 10/1991 | Shaffer | 75/252 |

*Primary Examiner*—Donald P. Walsh
*Assistant Examiner*—John N. Greaves
*Attorney, Agent, or Firm*—Bill C. Panagos

[57] ABSTRACT

A process for making a non magnetic Ni-WC cemented carbide composition and articles made from the same. The process comprises:

(a) dewaxing a green Ni-WC cemented carbide substrate in the presence of hydrogen gas at a pressure less than about 1000 torr and at a sufficient flow rate and a sufficient time to affect the saturation magnetization and magnetic permeability of the Ni-WC cemented carbide substrate;

(b) pumping out the hydrogen gas and introducing argon at a pressure in the range of about 1 torr to 1000 torr;

(c) increasing the temperature up to the sintering temperature to facilitate sintering of the Ni-WC cemented carbide substrate; and;

(d) cooling the furnace to room temperature.

The articles made according to this invention are useful as wear parts for electronic instruments and as punches form aluminum beverage cans.

10 Claims, 2 Drawing Sheets

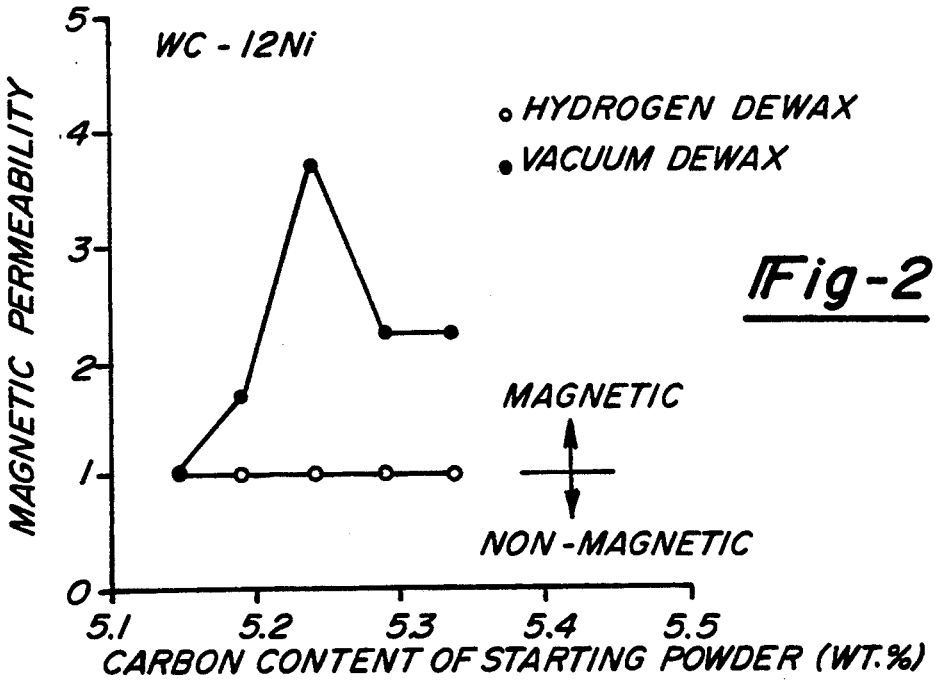
Fig-2
Fig-3
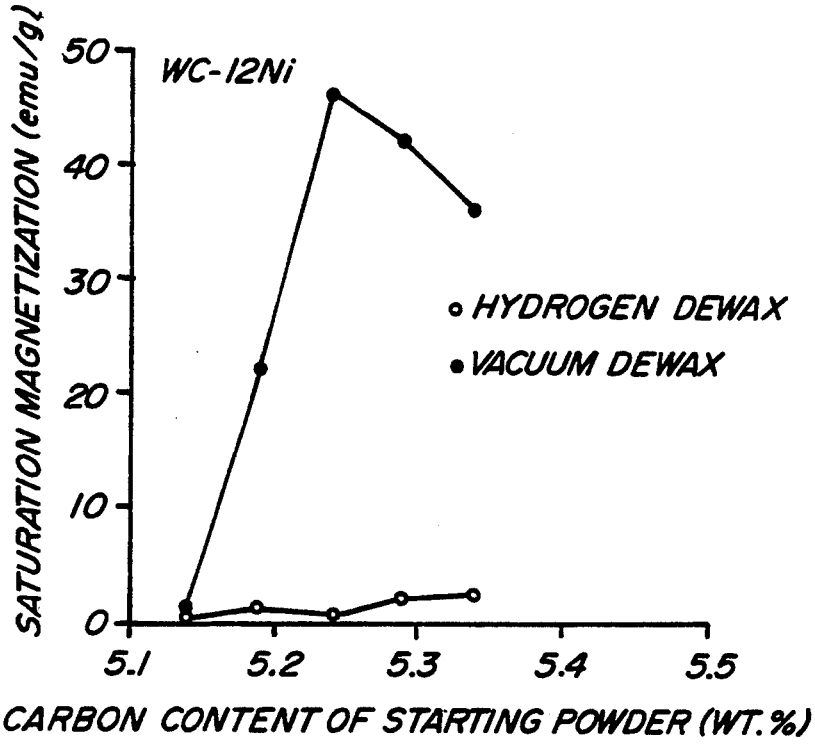

PROCESS FOR MAKING NON-MAGNETIC NICKEL TUNGSTEN CARBIDE CEMENTED CARBIDE COMPOSITIONS AND ARTICLES MADE FROM THE SAME

BACKGROUND OF THE INVENTION

1. Field of the Invention

The present invention relates to a process for making nonmagnetic nickel tungsten carbide cemented carbide compositions and articles made from the same.

The present invention further relates to an improved sintering process to affect the magnetic properties of Ni-WC cemented carbide compositions.

The present invention further relates to punches for forming aluminum cans which are essentially non-magnetic and wear resistant parts in electronic instruments.

Other objects will become apparent to those skilled in the art upon a reading of the specification.

2. Description of the Related Art

Nemeth et.al, U.S. Pat. No. 3,918,138 describe compositions for producing non-magnetic cemented carbides based upon Ni binders. In general, Ni is the least magnetic among the ferromagnetic elements. Ni-binder cemented carbides are thus usually "weakly" magnetic. Nemeth '138 adds Ti to render the Ni-binder cemented carbides completely non-magnetic. The drawback to Ti addition is that Ti is a very strong carbide former, and hence Ti addition will invariably de-carburize the WC present in the cemented carbide. This often leads to the formation of highly undesirable brittle eta-phase by the formation of $Ni_2W_4C$.

Another conceivable method of obtaining non-magnetic properties in Ni-WC compositions is by the very careful control of the carbon level in the starting powders.

The present invention controls the magnetic properties of Ni-WC compositions entirely by using hydrogen gas during the initial sintering of the composition. Also, the present invention does not rely upon the addition of any other elements in order to obtain non-magnetic behavior in Ni-WC compositions. Further, the present invention does not rely upon very careful control of the carbon level in the starting powders.

SUMMARY OF THE INVENTION

Cemented hardmetal carbides are technologically important materials because they offer attractive combinations of hardness, wear resistance, strength, and toughness. Most of the common cemented carbides are based on cobalt binder systems, while some are based on nickel binder systems. Since cobalt and nickel are ferromagnetic elements, both cobalt and nickel based cemented carbides are relatively magnetic. However, since cobalt has a substantially higher saturation magnetization and magnetic permeability, cobalt binder cemented carbides are substantially more magnetic compared to nickel binder cemented carbides.

There are several areas which require the material to exhibit a combination of wear resistance, strength, and toughness typical of common cemented carbides, along with non-magnetic behavior. Examples of such applications include punches used to form aluminum beverage cans and wear resistant parts in electronic instruments. Generally such non-magnetic compositions are based on Ni-WC compositions, and are made using the technique described by Nemeth in U.S. Pat. No. 3,918,138. It has been discovered, however, that non-magnetic behavior in Ni-WC compositions may be obtained through careful control of the sintering process, and without any compositional modifications as described by Nemeth in '138.

Sintering of Ni-WC compositions is typically carried out in vacuum. The essential steps are: (i) heating up and holding the green parts at a temperature of between 250 and 500 degrees centigrade for times ranging from 30 to 200 minutes to drive away the wax usually present in the green parts, and (ii) further heating and holding the parts temperatures of between 1260 and 1500 degrees centigrade for times ranging from 30 to 150 minutes, and (iii) cooling the sintered parts back to room temperature.

It has been discovered that if the dewaxing step is carried out in hydrogen, instead of vacuum, followed by final sintering under vacuum, the magnetic properties of the nickel binder cemented carbides are relatively insensitive to the carbon content in the starting powders, and that the sintered parts are invariably non-magnetic. Thus non-magnetic properties in Ni--WC compositions are obtainable without any special compositional modifications. Further, a particularly novel feature of the present invention is that careful control of the carbon content in the starting powder is not necessary to obtain non-magnetic properties. Rather, these properties are ensured by using hydrogen gas during the dewaxing process, even when the carbon content of the starting powder is varied over a relatively wide range.

BRIEF DESCRIPTION OF THE DRAWINGS

FIG. 2 is a graph showing the comparison between dewaxing in vacuum versus dewaxing in hydrogen on the magnetic permeability of a 12Ni-WC composition.

FIG. 3 is a graph showing the comparison between dewaxing in vacuum versus dewaxing in hydrogen on the saturation magnetization of a 12Ni-WC composition.

DETAILED DESCRIPTION OF THE PRESENT EMBODIMENT

Figure 1:
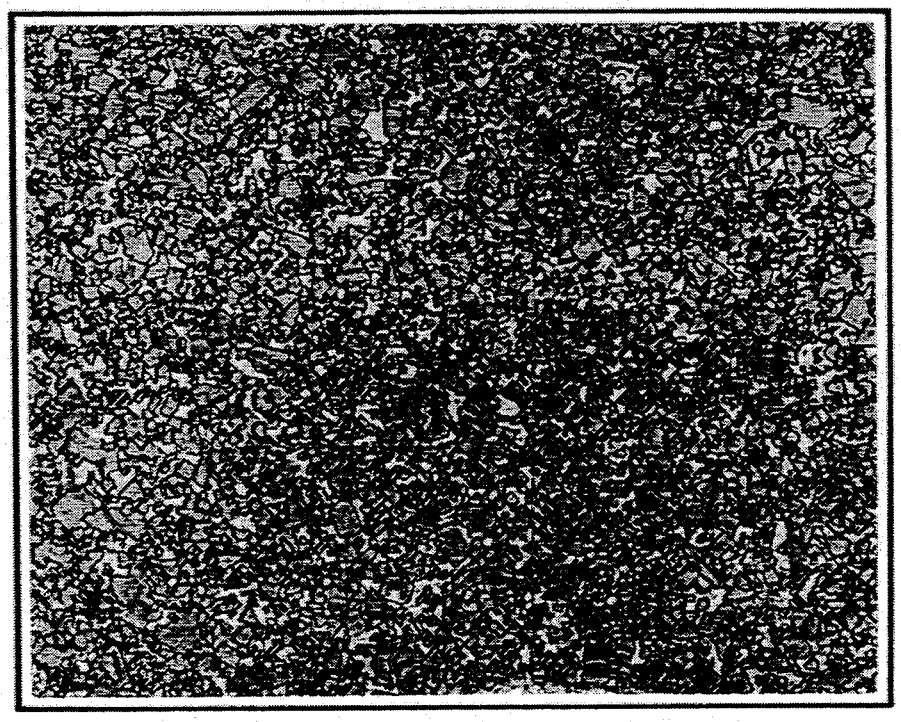
FIG. 1 is a photomicrograph of the Ni-WC cemented carbide composition of the present invention.

The present invention is a process for making non-magnetic Ni-WC cemented carbide compositions and articles made from the same. The Ni-WC cemented carbide composition is from about 2 to 30 percent by weight Ni, with the balance being substantially WC. Minor amounts of additional binders and tougheners may be present without affecting the process of the present invention.

The process involves placing green Ni-WC cemented carbide parts into a vacuum furnace and dewaxing at a temperature between about 300 and 500 degrees centigrade, and preferably between about 350 and 450 degrees centigrade, in the presence of hydrogen gas. The flow of gas may be continuous or pulsed, and the flow rate is such that the pressure inside the furnace is between about 1 torr and 1000 torr. The flow rate of the hydrogen gas may be in the range of about 2 to 100 liters per minute depending upon the size of the furnace and the capacity of the vacuum system. Once dewaxing is completed, the hydrogen gas is pumped out and an inert gas, such as argon, is introduced such that the pressure inside the furnace is between 1 torr and 1000 torr. The temperature is then increased until the final sintering temperature of the Ni-WC composition reached. In most situations the sintering is in the range of about 1260 to 1500 degrees temperature centigrade. When sintering is completed, the furnace is cooled to room temperature. The rate of cooling has no discernible effect on the magnetic properties of the composition.

As can be seen in FIG. 2, the process of the present invention yields a magnetic permeability of about 1.01, regardless of the initial carbon content of the starting powder. In contrast, the magnetic permeability of the same composition is strongly dependent on the initial carbon content when vacuum dewaxing is employed.

As also can be seen in FIG. 3, the process of the present invention yields a saturation magnetization of between about 0 and 5 emu/g, regardless of the initial carbon content of the starting powders.

The following examples are given to illustrate various aspects of the invention. Those skilled in the art will recognize that these examples are not limiting in any way to the scope and spirit of the invention.

EXAMPLES

All vacuum de-gas sintering runs were performed in a Vacuum Industries Sintervac furnace, while all hydrogen dewax sintering runs were performed using an Ultratemp furnace equipped with hydrogen dewaxing. 12Ni-WC compositions with various levels of starting carbon content were prepared by ball milling Ni, WC, and graphite powders. Two percent (2%) paraffin wax was also added to aid in the consolidation of the powders. Two identical sets of green parts made from the various powders were prepared, with one set being sintered using the vacuum dewax cycle and the other set being sintered using the hydrogen dewax cycle. The essential steps in the sintering cycle were then identical for both the vacuum dewax and hydrogen dewax cycles. These steps consisted of:

1. Placing the parts in the furnace and creating a vacuum within the furnace.
2. A dewax step consisting of heating the parts to a temperature of 430 degrees centigrade and holding at that temperature for 120 minutes.
3. Introduction of argon into the furnace so that the pressure inside the furnace was 600 torr.
4. Further heating the parts to a temperature of 1400 degrees centigrade and holding the parts at that temperature for 100 minutes for final sintering.
5. Cooling the parts back to room temperature.

The only difference between the vacuum dewax and hydrogen dewax cycles was that hydrogen gas was introduced into the furnace for the hydrogen dewax cycle. A sufficient flow rate of hydrogen was maintained so that a pressure of about 100 torr was obtained within the furnace. As soon as the dewax step was completed, the flow of hydrogen gas was shut off. In the vacuum dewax cycle no hydrogen was introduced. In all other respects the two cycles were the same.

The magnetic permeability and saturation magnetization of the sintered parts were determined. FIG. 2 shows that the hydrogen dewax parts were essentially non-magnetic (permeability less than 1.01) regardless of the starting carbon content. In contrast, the permeability of the vacuum dewax parts depended strongly upon the starting carbon content.

FIG. 3 shows that the hydrogen dewax parts exhibited a saturation magnetization of less than 5 emu/g in all cases, whereas the saturation magnetization of the vacuum dewax parts depended strongly upon the starting carbon content of the powders.

Therefore, the starting carbon content of the powders did not have any effect on the magnetic properties of Ni-WC compositions according to the present invention.

We claim:

1. A process for making non magnetic Ni-WC cemented carbide articles in a furnace, said process comprising:

(a) dewaxing a green Ni-WC cemented carbide substrate in the presence of hydrogen gas at a pressure less than about 1000 torr and at a sufficient flow rate and a sufficient time to affect the saturation magnetization and magnetic permeability of the Ni-WC cemented carbide substrate;

(b) pumping out the hydrogen gas and introducing argon at a pressure in the range of about 1 torr to 1000 torr;

(c) increasing the temperature up to the sintering temperature to facilitate sintering of the Ni-WC cemented carbide substrate; and (d) cooling the furnace to room temperature.

2. The process of claim 1, wherein the hydrogen gas flow is continuous.

3. The process of claim 1, wherein the hydrogen gas flow is pulsed.

4. The process of claim 1, wherein the hydrogen gas flow is introduced at pressures in the range of about 1 torr to about 1000 torr, and at a flow rate of from about 2 to about 100 liters per minute.

5. The process of claim 1, wherein the hydrogen gas is allowed to react with the cemented carbide substrates for up to about 200 minutes, and preferably, up to about 120 minutes.

6. The process of claim 1, wherein the magnetic permeability of the Ni-WC article is about 1.01.

7. The process of claim 1, wherein the saturation magnetization of the Ni-WC article is in the range of about o emu/g to about 5 emu/g.

8. The process of claim 1, wherein the sintering temperature of Ni-WC composite is in the range of about 1,260 to about 1,500 degrees centigrade.

9. The process of claim 1, wherein the dewaxing occurs at a temperature in the range of about 300 to 500 degrees centigrade, and preferably at 430 degrees centigrade.

10. The process of claim 1, wherein the Ni-WC article is comprised of from about 2 to 30 percent by weight Ni, with the balance substantially comprised of WC.

* * * * *